US008647712B2

(12) United States Patent
Moorlag et al.

(10) Patent No.: US 8,647,712 B2
(45) Date of Patent: Feb. 11, 2014

(54) METHOD FOR MANUFACTURING FUSER MEMBERS

(75) Inventors: Carolyn P. Moorlag, Mississauga (CA); Qi Zhang, Milton (CA); Suxia Yang, Mississauga (CA); Yu Qi, Oakville (CA); Brynn M. Dooley, Toronto (CA); Sandra J. Gardner, Oakville (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/448,822

(22) Filed: Apr. 17, 2012

(65) Prior Publication Data

US 2013/0273243 A1 Oct. 17, 2013

(51) Int. Cl.

| | |
|---|---|
| ***B05D 1/12*** | (2006.01) |
| ***B05D 1/02*** | (2006.01) |
| ***B05D 3/00*** | (2006.01) |
| ***B05D 1/04*** | (2006.01) |

(52) U.S. Cl.
USPC ..... 427/180; 427/421.1; 427/194; 427/458; 427/483; 427/475

(58) Field of Classification Search
USPC ..... 427/180–204, 475, 485, 476, 421.1, 427/458, 483
See application file for complete search history.

(56) References Cited

U.S. PATENT DOCUMENTS

| | | | | |
|---|---|---|---|---|
| 4,451,634 | A | 5/1984 | Hatanaka et al. | |
| 4,711,818 | A | 12/1987 | Henry | |
| 5,363,180 | A | 11/1994 | Shimizu et al. | |
| 5,666,592 | A | 9/1997 | Aslam et al. | |
| 5,709,973 | A | 1/1998 | Chen et al. | |
| 5,716,750 | A | 2/1998 | Tyagi et al. | |
| 5,729,813 | A * | 3/1998 | Eddy et al. | 399/333 |
| 5,887,235 | A | 3/1999 | Wayman et al. | |
| 6,087,729 | A | 7/2000 | Cerofolini et al. | |
| 6,101,345 | A | 8/2000 | Van Goethem et al. | |
| 6,113,830 | A * | 9/2000 | Chen et al. | 264/241 |
| 6,438,336 | B1 | 8/2002 | Bengtson | |
| 6,927,006 | B2 | 8/2005 | Finn et al. | |
| 6,983,119 | B2 | 1/2006 | Nakayama | |
| 7,088,946 | B2 | 8/2006 | Behnke et al. | |
| 7,395,021 | B2 | 7/2008 | Tamura et al. | |
| 7,754,121 | B2 | 7/2010 | Ristic-Lehmann et al. | |
| 8,029,871 | B2 | 10/2011 | Nakayama et al. | |
| 8,135,324 | B2 | 3/2012 | Moorlag | |
| 2001/0034158 | A1 | 10/2001 | Matsubara | |
| 2003/0207078 | A1 | 11/2003 | Finn et al. | |
| 2004/0034158 | A1 | 2/2004 | Reuter et al. | |
| 2005/0100728 | A1 | 5/2005 | Ristic-Lehmann et al. | |
| 2007/0231615 | A1 | 10/2007 | Tsujimoto et al. | |
| 2008/0070041 | A1 | 3/2008 | Kuntz et al. | |
| 2008/0241415 | A1 * | 10/2008 | Stelter et al. | 427/470 |

(Continued)

OTHER PUBLICATIONS

"ResonantAcoustic Mixing", Resodyn Acoustic Mixers, E.V. Roberts, Nov. 6, 2011, pp. 1-8.*

(Continued)

*Primary Examiner* — Frederick Parker
*Assistant Examiner* — Ann Disarro
(74) *Attorney, Agent, or Firm* — Hoffman Warnick LLC

(57) ABSTRACT

The present teachings describe a process that includes obtaining a composition of particles comprising fluorine containing particles and aerogel particles. The composition is mixed at a resonant frequency of a mixing system containing the composition. The composition is powder coated onto a substrate and cured to form a release layer on the substrate.

18 Claims, 4 Drawing Sheets

(56) References Cited

U.S. PATENT DOCUMENTS

| | | | | |
|---|---|---|---|---|
| 2008/0311398 | A1 | 12/2008 | Bauer et al. | |
| 2009/0247648 | A1 | 10/2009 | Zhao | |
| 2010/0226701 | A1* | 9/2010 | Moorlag | 399/333 |
| 2012/0244469 | A1 | 9/2012 | Zwartz et al. | |

OTHER PUBLICATIONS

"SpectrAl Series Fumed Alumina for Powder Coating Processes", CABOT Corporation, MA, U.S.A., 2005, pp. 1-2.*
U.S. Appl. No. 13/053,423, Office Action dated Feb. 22, 2013.
U.S. Appl. No. 13/053,418, Notice of Allowance and Fees Due dated Dec. 28, 2012.
U.S. Appl. No. 13/251,364, filed Oct. 3, 2011.
U.S. Appl. No. 13/182,015, filed Jul. 13, 2011.
U.S. Appl. No. 13/053,730, filed Mar. 22, 2011.
U.S. Appl. No. 13/053,423, filed Mar. 22, 2011.
U.S. Appl. No. 13/053,418, filed Mar. 22, 2011.
U.S. Appl. No. 13/288,494, filed Nov. 3, 2011.
U.S. Appl. No. 13/053,418, filed Mar. 22, 2011, Office Action dated Apr. 17, 2012.
"Dow Corning VM-2270 Aerogel Fine Particles" Dow Corning Corporation 2008.
Buie-Hatcher, Final Office Action, U.S. Appl. No. 13/053,418, Sep. 19, 2012.
U.S. Appl. No. 13/251,364, Office Action dated Apr. 11, 2013.
U.S. Appl. No. 13/288,494, Ex Parte Quayle dated Apr. 17, 2013.
U.S. Appl. No. 13/053,423, Office Action dated Jun. 17, 2013.

* cited by examiner

METHOD FOR MANUFACTURING FUSER MEMBERS

CROSS REFERENCE TO RELATED APPLICATIONS

This application relates to commonly assigned copending application Ser. No. 13/448,808, filed simultaneously herewith and incorporated by reference in its entirety herein.

BACKGROUND

1. Field of Use

The present disclosure relates to processes for producing fuser members.

2. Background

This disclosure relates generally to fuser members and their outermost layer and a method for efficient manufacturing of the outermost layer of a fuser member.

Powder coating of mixtures of silica aerogel, fluorine particles, and additives (for low gloss fusing topcoats) is a preferred processing method for production of fuser outermost layers. However, mixing of aerogel powder with fluorine containing particles presents certain issues. Traditional blending methods using a rotating blade, which are suitable for toner blending, exert too much force when combined with friable aerogel particles. The breaking down of aerogel particles to create aerogel fines results in severe wetting issues during curing, and non-cohesive coatings. Gentler methods, such as roll mixing, do not provide adequate particle dispersion and result in clumping of particles. A mixing method is required that is both vigorous and gentle, for efficient mixing without breaking down particles.

There is a need to introduce a more efficient particle mixing process for powder coating. A reliable and less time intensive mixing process which produces uniform mixing without the production of fines is desired.

SUMMARY

According to an embodiment, there is provided a process that includes obtaining a composition of particles comprising fluorine containing particles and aerogel particles. The composition is mixed at a resonant frequency of a mixing system containing the composition. The composition is powder coated onto a substrate and cured to form a release layer on the substrate.

According to another embodiment, there is provided a process comprising obtaining a composition of particles comprising fluorine containing particles, aerogel particles and positive tribocharging particles. The composition is mixed at a resonant frequency of a mixing system containing the composition. The composition is powder coated onto a substrate; and cured to form a release layer on the substrate.

According to another embodiment there is provided a process comprising obtaining a composition of particles comprising perfluoroalkoxy resin particles, aerogel particles and positive charged fumed alumina particles. The composition is mixed at a resonant frequency of a mixing system containing the composition.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1:
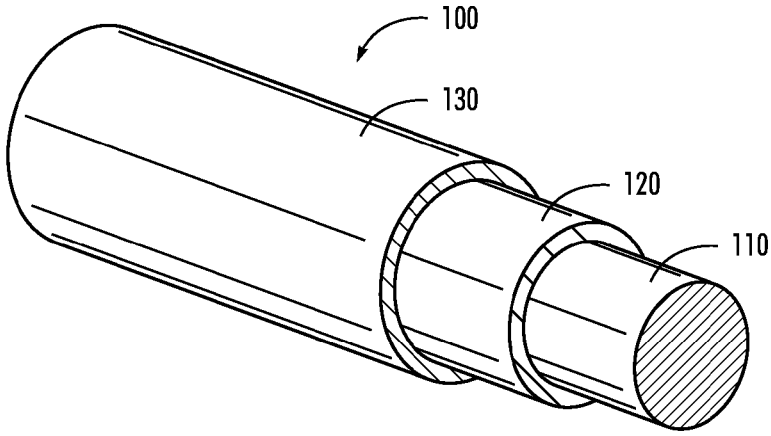
FIG. 1 depicts an exemplary fusing member having a cylindrical substrate in accordance with the present teachings.

It should be noted that some details of the figures have been simplified and are drawn to facilitate understanding of the embodiments rather than to maintain strict structural accuracy, detail, and scale.

DESCRIPTION OF THE EMBODIMENTS

In the following description, reference is made to the chemical formulas that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Furthermore, to the extent that the terms "including", "includes", "having", "has", "with", or variants thereof are used in either the detailed description and the claims, such terms are intended to be inclusive in a manner similar to the term "comprising." The term "at least one of" is used to mean that one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

The fixing or fuser member can include a substrate having one or more functional layers formed thereon. The one or more functional layers includes a surface coating or top layer having a surface wettability that is hydrophobic and/or oleophobic; ultrahydrophobic and/or ultraoleophobic; or superhydrophobic and/or superoleophobic. Such a fixing member can be used as an oil-less fusing member for high speed, high quality electrophotographic printing to ensure and maintain a good toner release from the fused toner image on the supporting material (e.g., a paper sheet), and further assist paper stripping.

In various embodiments, the fixing member can include, for example, a substrate, with one or more functional layers formed thereon. The substrate can be formed in various shapes, e.g., a cylinder (e.g., a cylinder tube), a cylindrical drum, a belt, or a film, using suitable materials that are non-conductive or conductive depending on a specific configuration, for example, as shown in FIGS. 1 and 2.

Figure 2:
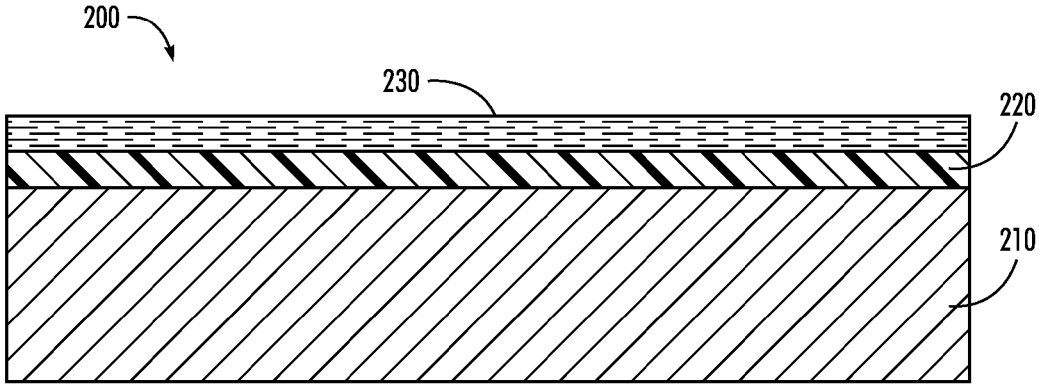
FIG. 2 depicts an exemplary fusing member having a belt substrate in accordance with the present teachings.

Specifically, FIG. 1 depicts an exemplary fixing or fusing member 100 having a cylindrical substrate 110 and FIG. 2 depicts another exemplary fixing or fusing member 200 having a belt substrate 210 in accordance with the present teachings. It should be readily apparent to one of ordinary skill in the art that the fixing or fusing member 100 depicted in FIG. 1 and the fixing or fusing member 200 depicted in FIG. 2 represent generalized schematic illustrations and that other layers/substrates can be added or existing layers/substrates can be removed or modified.

In FIG. 1 the exemplary fixing member 100 can be a fuser roller having a cylindrical substrate 110 with one or more functional layers 120 (also referred to as intermediate layers) and an outer layer 130 formed thereon. In various embodiments, the cylindrical substrate 110 can take the form of a cylindrical tube, e.g., having a hollow structure including a heating lamp therein, or a solid cylindrical shaft. In FIG. 2, the exemplary fixing member 200 can include a belt substrate 210 with one or more functional layers, e.g., 220 and an outer surface 230 formed thereon. The belt substrate 210 and the cylindrical substrate 110 can be formed from, for example, polymeric materials (e.g., polyimide, polyaramide, polyether ether ketone, polyetherimide, polyphthalamide, polyamide-imide, polyketone, polyphenylene sulfide, fluoropolyimides or fluoropolyurethanes) and metal materials (e.g., aluminum or stainless steel) to maintain rigidity and structural integrity as known to one of ordinary skill in the art.

Substrate Layer

The substrate layer 110, 210 in FIGS. 1 and 2 can be in a form of, for example, a belt, plate, and/or cylindrical drum for the disclosed fuser member. The substrate of the fusing member is not limited, as long as it can provide high strength and physical properties that do not degrade at a fusing temperature. Specifically, the substrate can be made from a metal, such as aluminum or stainless steel or a plastic of a heat-resistant resin. Examples of the heat-resistant resin include a polyimide, an aromatic polyimide, polyether imide, polyphthalamide, polyester, and a liquid crystal material such as a thermotropic liquid crystal polymer and the like. The thickness of the substrate falls within a range where rigidity and flexibility enabling the fusing belt to be repeatedly turned can be compatibly established, for instance, ranging from about 10 micrometers to about 200 micrometers or from about 30 micrometers to about 100 micrometers.

Functional Layer

Examples of functional layers 120 and 220 include fluorosilicones, silicone rubbers such as room temperature vulcanization (RTV) silicone rubbers, high temperature vulcanization (HTV) silicone rubbers, and low temperature vulcanization (LTV) silicone rubbers. These rubbers are known and readily available commercially, such as SILASTIC® 735 black RTV and SILASTIC® 732 RTV, both from Dow Corning; 106 RTV Silicone Rubber and 90 RTV Silicone Rubber, both from General Electric; and JCR6115CLEAR HTV and SE4705U HTV silicone rubbers from Dow Corning Toray Silicones. Other suitable silicone materials include the siloxanes (such as polydimethylsiloxanes); fluorosilicones such as Silicone Rubber 552, available from Sampson Coatings, Richmond, Va.; liquid silicone rubbers such as vinyl crosslinked heat curable rubbers or silanol room temperature crosslinked materials; and the like. Another specific example is Dow Corning Sylgard 182. Commercially available LSR rubbers include Dow Corning Q3-6395, Q3-6396, SILASTIC® 590 LSR, SILASTIC® 591 LSR, SILASTIC® 595 LSR, SILASTIC® 596 LSR, and SILASTIC® 598 LSR from Dow Corning. The functional layers provide elasticity and can be mixed with inorganic particles, for example SiC or $Al_2O_3$, as required.

Examples of functional layers 120 and 220 also include fluoroelastomers. Fluoroelastomers are from the class of 1) copolymers of two of vinylidenefluoride, hexafluoropropylene, and tetrafluoroethylene; such as those known commercially as VITON A®, 2) terpolymers of vinylidenefluoride, hexafluoropropylene, and tetrafluoroethylene such as those known commercially as VITON B®; and 3) tetrapolymers of vinylidenefluoride, hexafluoropropylene, tetrafluoroethylene, and a cure site monomer, such as those known commercially as VITON GH® or VITON GF®. These fluoroelastomers are known commercially under various designations such as those listed above, along with VITON E®, VITON E 60C®, VITON E430®, VITON 910®, and VITON ETP®. The VITON® designation is a trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer, such as those commercially available from DuPont. Other commercially available fluoropolymers include FLUOREL 2170®, FLUOREL 2174®, FLUOREL 2176®, FLUOREL 2177® and FLUOREL LVS 76®, FLUOREL® being a registered trademark of 3M Company. Additional commercially available materials include AFLAS™ a poly(propylene-tetrafluoroethylene), and FLUOREL II® (LII900) a poly(propylene-tetrafluoroethylenevinylidenefluoride), both also available from 3M Company, as well as the tecnoflons identified as FOR-60KIR®, FOR-LHF®, NM® FOR-THF®, FOR-TFS®, TH®, NH®, P757®, TNS®, T439®, PL958®, BR9151®, and TN505®, available from Ausimont.

The fluoroelastomers VITON GH® and VITON GF® have relatively low amounts of vinylidenefluoride. VITON GF® and VITON GH® have about 35 weight percent of vinylidenefluoride, about 34 weight percent of hexafluoropropylene, and about 29 weight percent of tetrafluoroethylene, with about 2 weight percent cure site monomer.

For a roller configuration, the thickness of the functional layer can be from about 0.5 mm to about 10 mm, or from about 1 mm to about 8 mm, or from about 2 mm to about 7 mm. For a belt configuration, the functional layer can be from about 25 microns up to about 2 mm, or from 40 microns to about 1.5 mm, or from 50 microns to about 1 mm.

Adhesive Layer(s)

Optionally, any known and available suitable adhesive layer, also referred to as a primer layer, may be positioned between the release layer 130, 230, the intermediate layer 120, 220 and the substrate 110, 210. Examples of suitable adhesives include silanes such as amino silanes (such as, for example, HV Primer 10 from Dow Corning), titanates, zirconates, aluminates, and the like, and mixtures thereof. In an embodiment, an adhesive in from about 0.001 percent to about 10 percent solution can be wiped on the substrate. Optionally, any known and available suitable adhesive layer may be positioned between the release layer or outer surface, the functional layer and the substrate. The adhesive layer can be coated on the substrate, or on the functional layer, to a thickness of from about 2 nanometers to about 10,000 nanometers, or from about 2 nanometers to about 1,000 nanometers, or from about 2 nanometers to about 5000 nanometers. The adhesive can be coated by any suitable known technique, including spray coating or wiping.

Release Layer

Fluoroplastic coatings that include aerogel particles into the topcoat matrix have been used to obtain low gloss images in fuser members. U.S. Ser. No. 13/053,418, incorporated in its entirety herein, describes such release layers. However, processing of powder fluoroplastic/aerogel mixtures remains a challenge. Powder coating is a desirable processing method for fuser coatings; however, fluoroplastic and aerogel powders have a tendency to separate during powder coating processing resulting in incomplete curing and non-homogeneous release layers. It is desirable to find a homogeneous powder mixture while powder coating that promotes cohesion of the cured topcoat.

Fluoroplastic and aerogel powders are two dissimilar powders that must be coated and cured together to form a fusing topcoat suitable to prepare low gloss prints.

An exemplary embodiment of a release layer 130 or 230 includes fluoroplastics having aeorgel particles. Examples of fluoroplastics include polytetrafluoroethylene (PTFE); perfluoroalkoxy polymer resin (PFA); copolymer of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF), and hexafluoropropylene (HFP); and tetrapolymers of tetrafluoroethylene (TFE), vinylidene fluoride (VF2), hexafluoropropylene (HFP) and a cure site monomer, and mixtures thereof. The fluoroplastics provide chemical and thermal stability and have a low surface energy. The fluoroplastics have a melting temperature of from about 255° C. to about 400° C. or from about 280° C. to about 380° C.

For the fuser member 200, the thickness of the outer surface layer or release layer 230 can be from about 10 microns to about 100 microns, or from about 20 microns to about 80 microns, or from about 30 microns to about 50 microns.

Additives and additional conductive or non-conductive fillers may be present in the intermediate layer substrate layers 110 and 210, the intermediate layers 120 and 220 and the release layers 130 and 230. In various embodiments, other filler materials or additives including, for example, inorganic particles, can be used for the coating composition and the subsequently formed surface layer. Conductive fillers used herein may include carbon blacks such as carbon black, graphite, fullerene, acetylene black, fluorinated carbon black, and the like; carbon nanotubes; metal oxides and doped metal oxides, such as tin oxide, antimony dioxide, antimony-doped tin oxide, titanium dioxide, indium oxide, zinc oxide, indium oxide, indium-doped tin trioxide, and the like; and mixtures thereof. Certain polymers such as polyanilines, polythiophenes, polyacetylene, poly(p-phenylene vinylene), poly (p-phenylene sulfide), pyrroles, polyindole, polypyrene, polycarbazole, polyazulene, polyazepine, poly(fluorine), polynaphthalene, salts of organic sulfonic acid, esters of phosphoric acid, esters of fatty acids, ammonium or phosphonium salts and mixtures thereof can be used as conductive fillers. In various embodiments, other additives known to one of ordinary skill in the art can also be included to form the disclosed composite materials.

Figure 3A:
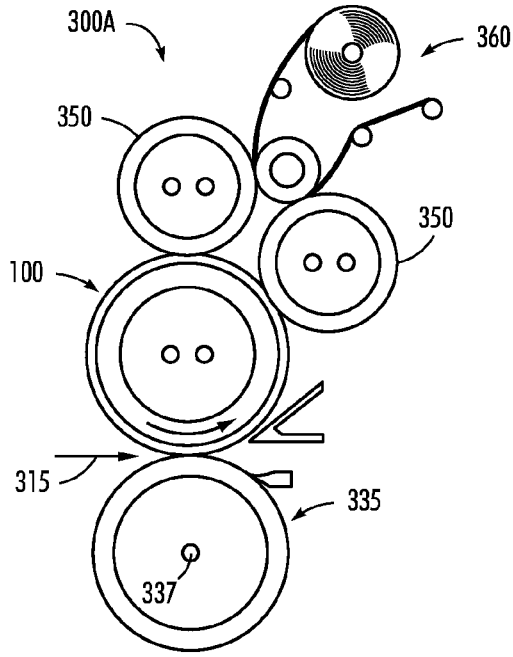
FIGS. 3A-3B depict exemplary fusing configurations using the fuser rollers shown in FIG. 1 in accordance with the present teachings.
Figure 3B:
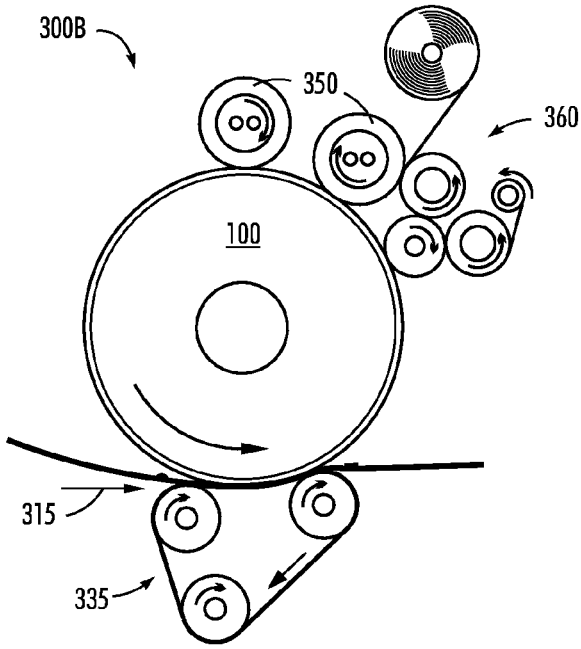
Figure 4A:
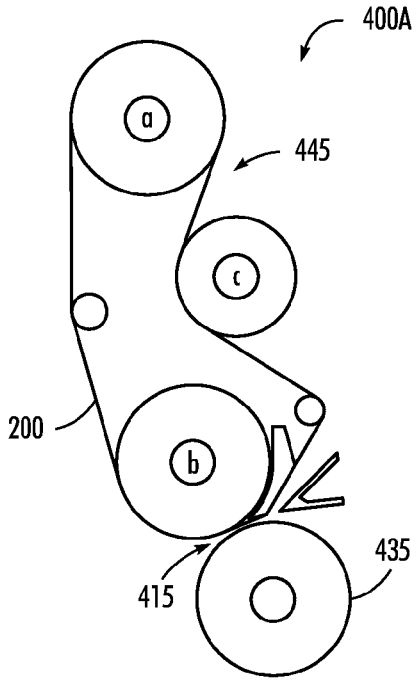
FIGS. 4A-4B depict another exemplary fusing configurations using the fuser belt shown in FIG. 2 in accordance with the present teachings.
Figure 4B:
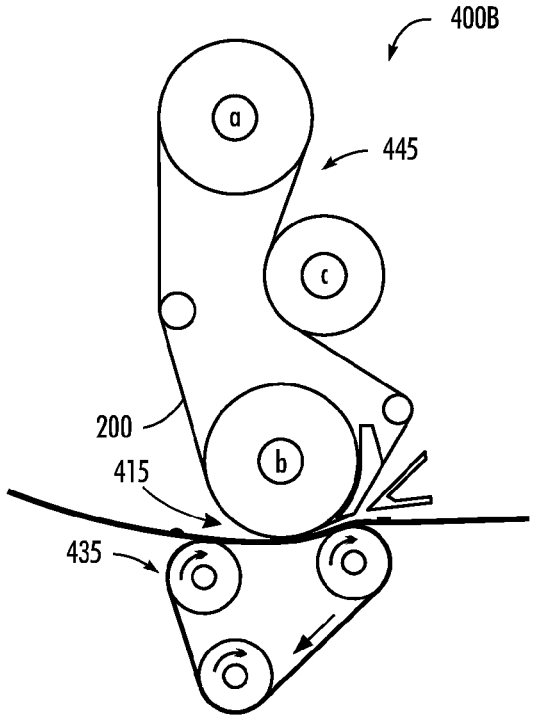

FIGS. 3A-4B and FIGS. 4A-4B depict exemplary fusing configurations for the fusing process in accordance with the present teachings. It should be readily apparent to one of ordinary skill in the art that the fusing configurations 300A-B depicted in FIGS. 3A-3B and the fusing configurations 400A-B depicted in FIGS. 4A-4B represent generalized schematic illustrations and that other members/layers/substrates/configurations can be added or existing members/layers/substrates/configurations can be removed or modified. Although an electrophotographic printer is described herein, the disclosed apparatus and method can be applied to other printing technologies. Examples include offset printing and inkjet and solid transfix machines.

FIGS. 3A-3B depict the fusing configurations 300A-B using a fuser roller shown in FIG. 1 in accordance with the present teachings. The configurations 300A-B can include a fuser roller 100 (i.e., 100 of FIG. 1) that forms a fuser nip with a pressure applying mechanism 335, such as a pressure roller in FIG. 3A or a pressure belt in FIG. 3B, for an image supporting material 315. In various embodiments, the pressure applying mechanism 335 can be used in combination with a heat lamp 337 to provide both the pressure and heat for the fusing process of the toner particles on the image supporting material 315. In addition, the configurations 300A-B can include one or more external heat roller 350 along with, e.g., a cleaning web 360, as shown in FIG. 3A and FIG. 3B.

FIGS. 4A-4B depict fusing configurations 400A-B using a fuser belt shown in FIG. 2 in accordance with the present teachings. The configurations 400A-B can include a fuser belt 200 (i.e., 200 of FIG. 2) that forms a fuser nip with a pressure applying mechanism 435, such as a pressure roller in FIG. 4A or a pressure belt in FIG. 4B, for a media substrate 415. In various embodiments, the pressure applying mechanism 435 can be used in a combination with a heat lamp to provide both the pressure and heat for the fusing process of the toner particles on the media substrate 415. In addition, the configurations 400A-B can include a mechanical system 445 to move the fuser belt 200 and thus fusing the toner particles and forming images on the media substrate 415. The mechanical system 445 can include one or more rollers 445*a-c*, which can also be used as heat rollers when needed.

Figure 5:
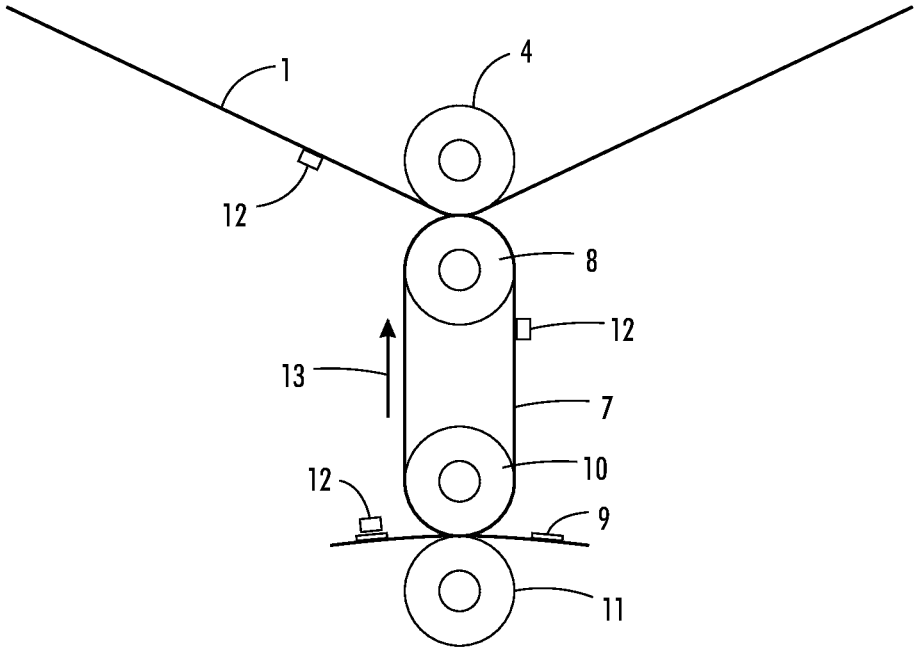
FIG. 5 depicts an exemplary fuser configuration using a transfix apparatus.

FIG. 5 demonstrates a view of an embodiment of a transfix member 7 which may be in the form of a belt, sheet, film, or like form. The transfix member 7 is constructed similarly to the fuser belt 200 described above. The developed image 12 positioned on intermediate transfer member 1 is brought into contact with and transferred to transfix member 7 via rollers 4 and 8. Roller 4 and/or roller 8 may or may not have heat associated therewith. Transfix member 7 proceeds in the direction of arrow 13. The developed image is transferred and fused to a copy substrate 9 as copy substrate 9 is advanced between rollers 10 and 11. Rollers 10 and/or 11 may or may not have heat associated therewith.

Disclosed herein is an acoustic mixing process for efficiently mixing together fluoroplastic, aerogel particles, and optionally positive tribocharging particles. The acoustic mixer uses low-frequency, high intensity acoustic energy, whereby a shear field is applied throughout the sample container. The acoustic mixing process is gentle enough that the aerogel particles are not broken down to create fine particles that can lead to poor curing of topcoats. Acoustic mixing also enables more homogeneous coatings through even distribution of additive particles that are required for efficient flow of powder mixtures as well as association between dissimilar particles. Finally, a mixing time of approximately 2 minutes required for acoustic mixing saves time and resources compared to alternative techniques.

Resonant acoustic mixing is distinct from conventional impeller agitation found in a planetary mixer or ultrasonic mixing. Low frequency, high-intensity acoustic energy is used to create a uniform shear field throughout the entire mixing vessel. The result is rapid fluidization (like a fluidized bed) and dispersion of material. In addition, resonant acoustic mixing is distinct from high shear cavitation mixing.

Resonant acoustic mixing differs from ultrasonic mixing in that the frequency of acoustic energy is orders of magnitude lower. As a result, the scale of mixing is larger. Unlike impeller agitation, which mixes by inducing bulk flow, the acoustic mixing occurs on a microscale throughout the mixing volume.

In acoustic mixing, acoustic energy is delivered to the components to be mixed. An oscillating mechanical driver creates motion in a mechanical system comprised of engineered plates, eccentric weights and springs. This energy is then acoustically transferred to the material to be mixed. The underlying technology principle is that the system operates at resonance. In this mode, there is a nearly complete exchange of energy between the mass elements and the elements in the mechanical system.

In a resonant acoustic mixing, the only element that absorbs energy (apart from some negligible friction losses) is the mix load itself. Thus, the resonant acoustic mixing provides a highly efficient way of transferring mechanical energy directly into the mixing materials. The resonant frequency can be from about 15 Hertz to about 2000 Hertz, or in embodiments from about 20 Hertz to about 1800 Hertz, or from about 20 Hertz to about 1700 Hertz. The resonant acoustic mixing is performed at an acceleration G force of from about 5 to about 100.

Acoustic mixers rely on a low frequency and low shear resonating energy technology to maximize energy efficiency for mixing. The resonant acoustic mixers vigorously shake the dispersion with up to 100 G of force. The dispersion is mixed at a resonant frequency to maximize energy usage. The process utilizes high intensity, low shear vibrations which induces the natural separation of loosely aggregated particles while simultaneously mixing all regions of the dispersion. This technology is useful for high viscosity systems. Resonant acoustic mixers are available from Resodyn™ Acoustic Mixers.

Low gloss prints may be obtained using fluoroplastic particles and silica aerogel as fusing topcoat layers on substrate. The use of low gloss fusing members (rolls or belts) to change print gloss has advantages over low gloss toner by enabling a fast changeover time, as well as extending the gloss range that can be obtained. Fluoroplastic/aerogel fuser coatings that allow for lower gloss prints have been demonstrated via spray coating from solvent dispersions and melt-curing the top layer in U.S. Ser. No. 13/053,423 filed Mar. 23, 2011 and incorporated in its entirety by reference herein. However, the spray coating process results in high variance between samples, due to particle settling. A desirable processing method for production coating of fuser members is powder coating.

Powder coating is a coating process involving the application of a free flowing, dry powder to a surface, followed by curing. The powder is electrostatically charged, and then directed to a grounded component to form the coating layer. With the application of heat, the powder will melt and flow to form the cured coating. Prior to powder coating, a powder combination must be mixed to form a homogenous powder, in order to produce a homogenous topcoat layer.

Powder mixtures of fluoroplastic and aerogel using an acoustic mixing process are provided. Using an acoustic mixing process, fluoroplastic particles and aerogel particles such as silica aerogel can be combined to produce a powder mixture suitable for powder coating. Other additives may also be efficiently dispersed within the powder mixture.

Effective mixing using the acoustic mixer takes place at the resonant frequency for the powder mixture and container, (the mixing system), and can be mixed in about 1 minute to about 5 minutes, or in embodiments from about 1.5 minutes to about 4 minutes, or in embodiments from about 2 minutes to about 3 minutes. The low frequency of mixing in an acoustic mixer allows for gentle mixing of particles, and does result in the breakage of the friable aerogel particles. Maintaining intact aerogel particles without creating fine particles is important for maintaining the desired size of aerogel particles for low-gloss or other applications requiring surface texture, and maintaining wettability during curing, as fine aerogel particles inhibit wetting to produce non-cohesive topcoat layers. The acoustic mixing process is easily scalable.

Acoustic mixing also allows for efficient addition of additive particles to fluoroplastic and aerogel mixtures. The addition of positive alumina tribocharging fine particles to fluoroplastic/aerogel mixtures has been demonstrated to associate partially negative PFA and partially negative aerogel particles together to promote a homogeneous powder mixture. Alumina additives also promote wettability and cohesion during the cure. The proposed acoustic mixing method effectively disperses additive particles. Multiple benefits for acoustic mixing of PFA/aerogel powders are evident.

A suitable positive tribocharging agent is fumed alumina. The fumed alumina can have a surface area of from about 30 $m^2/g$ to about 400 $m^2/g$, or from about 50 $m^2/g$ to about 300 $m^2/g$, or from about 100 $m^2/g$ to 200 $m^2/g$. The amount of tribocharged particles in the powder coating ranges from about 0.1 weight percent to about 5 weight percent, or from about 0.2 weight percent to about 3.0 weight percent, or from about 0.5 weight percent to about 1.5 weight percent of the total solids in the powder.

Suitable positive tribocharging particles comprise alumina, silica, zirconia, germania, or other positive metal oxide materials. Metal oxide tribocharging particles may be formed from fumed metal oxides, precipitated metal oxides, or from a gel. The size of the positive tribocharging particles are about 10 nm to about 5 microns in size, or from about 50 nm to about 1 micron, or from about 100 nm to about 500 nm.

Positive tribocharging particles used may be treated with a hydrophobic agent to render the particles hydrophobic. Hydrophobic agents used may include organosilane, organosiloxane, polyorganosiloxane, organosilazane, or polyorganosilazanes.

Positive tribocharging particles used may be treated with surface agents to enhance tribocharging behavior.

Positive tribocharging particles are approximately 5 nm to 1 microns in size, or 10 nm to 500 nm, or 20 nm to 100 nm.

Aerogels may be described, in general terms, as gels that have been dried to a solid phase by removing pore fluid and replacing the pore fluid with air. As used herein, an "aerogel" refers to a material that is generally a very low density ceramic solid, typically formed from a gel. The term "aerogel" is thus used to indicate gels that have been dried so that the gel shrinks little during drying, preserving its porosity and related characteristics. In contrast, "hydrogel" is used to describe wet gels in which pore fluids are aqueous fluids. The term "pore fluid" describes fluid contained within pore structures during formation of the pore element(s). Upon drying, such as by supercritical drying, aerogel particles are formed that contain a significant amount of air, resulting in a low density solid and a high surface area. In various embodiments, aerogels are thus low-density microcellular materials characterized by low mass densities, large specific surface areas and very high porosities. In particular, aerogels are characterized by their unique structures that comprise a large number of small interconnected pores. After the solvent is removed, the polymerized material is pyrolyzed in an inert atmosphere to form the aerogel.

Any suitable aerogel component can be used. In embodiments, the aerogel component can be, for example, selected from inorganic aerogels, organic aerogels, carbon aerogels, and mixtures thereof. In particular embodiments, ceramic aerogels can be suitably used. These aerogels are typically composed of silica, but may also be composed of metal oxides, such as alumina, titania and zirconia, or carbon, and can optionally be doped with other elements such as a metal. In some embodiments, the aerogel component can comprise aerogels chosen from polymeric aerogels, colloidal aerogels, and mixtures thereof.

The aerogel component can be either formed initially as the desired sized particles, or can be formed as larger particles and then reduced in size to the desired size. For example, formed aerogel materials can be ground, or they can be directly formed as nano to micron sized aerogel particles.

Aerogel particles of embodiments may have porosities of from about 50 percent to about 99.9 percent, in which the aerogel can contain 99.9 percent empty space. In embodiments the aerogel particles have porosities of from about 50 percent to about 99.0 percent, or from 50 percent to about 98 percent. In embodiments, the pores of aerogel components may have diameters of from about 2 nm to about 500 nm, or from about 10 nm to about 400 nm or from about 20 nm to about 100 nm. In particular embodiments, aerogel components may have porosities of more than 50 percent pores with diameters of less than 100 nm and even less than about 20 nm. In embodiments, the aerogel components may be in the form of particles having a shape that is spherical, or near-spherical, cylindrical, rod-like, bead-like, cubic, platelet-like, and the like.

In embodiments, the aerogel components include aerogel particles, powders, or dispersions ranging in average volume particle size of from about 1 μm to about 100 μm, or about 3 μm to about 50 μm, or about 5 μm to 20 μm. The aerogel components can include aerogel particles that appear as well dispersed single particles or as agglomerates of more than one particle or groups of particles within the polymer material.

Generally, the type, porosity, pore size, and amount of aerogel used for a particular embodiment may be chosen based upon the desired properties of the resultant composition and upon the properties of the polymers and solutions thereof into which the aerogel is being combined. For example, if a pre-polymer (such as a low molecular weight polyurethane monomer that has a relatively low process viscosity, for example less than 10 centistokes) is chosen for use in an embodiment, then a high porosity, for example greater than 80%, and high specific surface area, for example greater than about 500 $m^2$/gm, aerogel having relatively small pore size, for example less than about 100 nm, may be mixed at relatively high concentrations, for example greater than about 2 weight percent to about 20 weight percent, into the pre-polymer by use of moderate-to-high energy mixing techniques, for example by controlled temperature, high shear and/or blending. If a hydrophilic-type aerogel is used, upon cross-linking and curing/post curing the pre-polymer to form an infinitely long matrix of polymer and aerogel filler, the resultant composite may exhibit improved hydrophobicity and increased hardness when compared to a similarly prepared sample of unfilled polymer. The improved hydrophobicity may be derived from the polymer and aerogel interacting during the liquid-phase processing whereby, a portion of the molecular chain of the polymer interpenetrates into the pores of the aerogel and the non-pore regions of the aerogel serve to occupy some or all of the intermolecular space where water molecules could otherwise enter and occupy.

The continuous and monolithic structure of interconnecting pores that characterizes aerogel components also leads to high surface areas and, depending upon the material used to make the aerogel, the electrical conductivity may range from highly thermally and electrically conducting to highly thermally and electrically insulating. Further, aerogel components in embodiments may have surface areas ranging from about 400 $m^2$/g to about 1200 $m^2$/g, such as from about 500 $m^2$/g to about 1200 $m^2$/g, or from about 700 $m^2$/g to about 900 $m^2$/g. In embodiments, aerogel components may have electrical resistivities greater than about $1.0\times10^{-4}$ Ω-cm, such as in a range of from about 0.01 Ω-cm to about $1.0\times10^{16}$ Ω-cm, from about 1 Ω-cm to about $1.0\times10^{8}$ Ω-cm, or from about 50 Ω-cm to about 750,000 Ω-cm. Different types of aerogels used in various embodiments may also have electrical resistivities that span from conductive, about 0.01 Ω-cm to about 1.00 Ω-cm, to insulating, more than about $10^{16}$ Ω-cm. Conductive aerogels of embodiments, such as carbon aerogels, may be combined with other conductive fillers to produce combinations of physical, mechanical, and electrical properties that are otherwise difficult to obtain.

Aerogels that can suitably be used in embodiments may be divided into three major categories: inorganic aerogels, organic aerogels and carbon aerogels. In embodiments, the fuser member layer may contain one or more aerogels chosen from inorganic aerogels, organic aerogels, carbon aerogels and mixtures thereof. For example, embodiments can include multiple aerogels of the same type, such as combinations of two or more inorganic aerogels, combinations of two or more organic aerogels, or combinations of two or more carbon aerogels, or can include multiple aerogels of different types, such as one or more inorganic aerogels, one or more organic aerogels, and/or one or more carbon aerogels. For example, a chemically modified, hydrophobic silica aerogel may be combined with a high electrical conductivity carbon aerogel to simultaneously modify the hydrophobic and electrical properties of a composite and achieve a desired target level of each property.

Inorganic aerogels, such as silica aerogels, are generally formed by sol-gel polycondensation of metal oxides to form highly cross-linked, transparent hydrogels. These hydrogels are subjected to supercritical drying to form inorganic aerogels.

Organic aerogels are generally formed by sol-gel polycondensation of resorcinol and formaldehyde. These hydrogels are subjected to supercritical drying to form organic aerogels.

Carbon aerogels are generally formed by pyrolyzing organic aerogels in an inert atmosphere. Carbon aerogels are composed of covalently bonded, nanometer-sized particles that are arranged in a three-dimensional network. Carbon aerogels, unlike high surface area carbon powders, have oxygen-free surfaces, which can be chemically modified to increase their compatibility with polymer matrices. In addition, carbon aerogels are generally electrically conductive, having electrical resistivities of from about 0.005 Ω-cm to about 1.00 Ω-cm. In particular embodiments, the composite may contain one or more carbon aerogels and/or blends of one or more carbon aerogels with one or more inorganic and/or organic aerogels.

Carbon aerogels that may be included in embodiments exhibit two morphological types, polymeric and colloidal, which have distinct characteristics. The morphological type of a carbon aerogel depends on the details of the aerogel's preparation, but both types result from the kinetic aggregation of molecular clusters. That is, nanopores, primary particles of carbon aerogels that may be less than 20 Å (Angstroms) in size and that are composed of intertwined nanocrystalline graphitic ribbons, cluster to form secondary particles, or mesopores, which may be from about 20 Å to about 500 Å in size. These mesopores can form chains to create a porous carbon aerogel matrix. The carbon aerogel matrix may be dispersed, in embodiments, into polymeric matrices by, for example, suitable melt blending or solvent mixing techniques.

In embodiments, carbon aerogels may be combined with, coated, or doped with a metal to improve conductivity, magnetic susceptibility, and/or dispersibility. Metal-doped carbon aerogels may be used in embodiments alone or in blends with other carbon aerogels and/or inorganic or organic aerogels. Any suitable metal, or mixture of metals, metal oxides and alloys may be included in embodiments in which metal-doped carbon aerogels are used. In particular embodiments, and in specific embodiments, the carbon aerogels may be doped with one or more metals chosen from transition metals (as defined by the Periodic Table of the Elements) and aluminum, zinc, gallium, germanium, cadmium, indium, tin, mercury, thallium and lead. In particular embodiments, carbon aerogels are doped with copper, nickel, tin, lead, silver, gold, zinc, iron, chromium, manganese, tungsten, aluminum, platinum, palladium, and/or ruthenium. For example, in embodiments, copper-doped carbon aerogels, ruthenium-doped carbon aerogels and mixtures thereof may be included in the composite.

For example, as noted earlier, in embodiments in which the aerogel components comprise nanometer-scale particles, these particles or portions thereof can occupy inter- and intramolecular spaces within the molecular lattice structure of the polymer, and thus can prevent water molecules from becoming incorporated into those molecular-scale spaces. Such blocking may decrease the hydrophilicity of the overall composite. In addition, many aerogels are hydrophobic. Incorporation of hydrophobic aerogel components may also decrease the hydrophilicity of the composites of embodiments. Composites having decreased hydrophilicity, and any components formed from such composites, have improved environmental stability, particularly under conditions of cycling between low and high humidity.

The aerogel particles can include surface functionalities selected from the group of alkylsilane, alkylchlorosilane, alkylsiloxane, polydimethylsiloxane, aminosilane and methacrylsilane. In embodiments, the surface treatment material contains functionality reactive to aerogel that result in modified surface interactions. Surface treatment also helps enable non-stick interaction on the composition surface.

In addition, the porous aerogel particles may interpenetrate or intertwine with the fluoroplastic and thereby strengthen the polymeric lattice. The mechanical properties of the overall composite of embodiments in which aerogel particles have interpenetrated or interspersed with the polymeric lattice may thus be enhanced and stabilized.

For example, in one embodiment, the aerogel component can be a silica silicate having an average particle size of 5-15 microns, a porosity of 90% or more, a bulk density of 40-100 $kg/m^3$, and a surface area of 600-800 $m^2/g$. Of course, materials having one or more properties outside of these ranges can be used, as desired.

Depending upon the properties of the aerogel components, the aerogel components can be used as is, or they can be chemically modified. For example, aerogel surface chemistries may be modified for various applications, for example, the aerogel surface may be modified by chemical substitution upon or within the molecular structure of the aerogel to have hydrophilic or hydrophobic properties. For example, chemical modification may be desired so as to improve the hydrophobicity of the aerogel components. When such chemical treatment is desired, any conventional chemical treatment well known in the art can be used. For example, such chemical treatments of aerogel powders can include replacing surface hydroxyl groups with organic or partially fluorinated organic groups, or the like.

In general, a wide range of aerogel components are known in the art and have been applied in a variety of uses. For example, many aerogel components, including ground hydrophobic aerogel particles, have been used as low cost additives in such formulations as hair, skincare, and antiperspirant compositions. One specific non-limiting example is the commercially available powder that has already been chemically treated, Dow Corning VM-2270 Aerogel fine particles having a size of about 5-15 microns.

Any suitable amount of the aerogel may be incorporated into the fluoroplastic component, to provide desired results. For example, the coating layer may be formed from about 0.1 weight percent to about 10 weight percent aerogel of the total weight of the surface coating, or from about 0.2 weight percent to about 5 weight percent aerogel of the total weight of the surface coating or from about 0.5 weight percent to about 2 weight percent of the total weight of the surface coating. The size of aerogel particles is from about 1 μm to about 100 μm, or about 3 μm to about 50 μm, or about 5 μm to 20 μm.

The surface coating has a surface free energy that is less than the surface energy of a fluoroplastic base layer that is used in the composite. This depends on the fluoroplastic. In embodiments fluoroplastics with aerogel particles dispersed therein produce a surface layer having a surface energy of less than 20 $mN/m^2$. In embodiments the surface free energy is less than 10 $mN/m^2$ for a superhydrophobic surface, or between 10 $mN/m^2$ and 2 $mN/m^2$, or is between 10 $mN/m^2$ and 5 $mN/m^2$, or is between 10 $mN/m^2$ and 7 $mN/m^2$.

The composition of fluoroplastic and aerogel is powder coated on a substrate to form a surface layer. During powder coating, the powder composition is electrostatically spray coated, electrostatic fluidized bed coated, electrostatic magnetic brush coated, or fluidized bed coated on a substrate in any suitable known manner.

Fluoroplastics such as Teflon and PFA are commonly processed from powders and then brought to melting temperature of from about 350° C. to about 400° C. to form a coherent coating. When aerogel and fluoroplastic particles are combined and brought to melting temperature, a fused fluororesin matrix is produced with embedded aerogel particles. The release layer incorporates aerogel fillers particles dispersed throughout a fluoroplastic matrix in ratios of 0.1 weight percent to 10 weight percent of the total solids in the release layer. In embodiments the aerogel amount was from about 0.2 weight percent to about 5 weight percent aerogel of the total weight of the release layer or from about 0.5 weight percent to about 2 weight percent of the total weight of the release layer. The size of fluoroplastic particles is from about 5 μm to about 50 μm, or about 8 μm to about 45 μm, or about 10 μm to 40 μm.

While embodiments have been illustrated with respect to one or more implementations, alterations and/or modifications can be made to the illustrated examples without departing from the spirit and scope of the appended claims. In addition, while a particular feature herein may have been disclosed with respect to only one of several implementations, such feature may be combined with one or more other features of the other implementations as may be desired and advantageous for any given or particular function.

EXAMPLES

Powder mixtures of 2.5 weight percent silica aerogel, 97.0 weight percent perfluoroalkoxy polymer (PFA) resin were combined with 0.5 weight percent SpectrAl™ 100 (95 $m^2/g$ fumed alumina) and mixed via four different mixing techniques: acoustic mixing, blending, Turbula, and paint shaking. The results are summarized below.

Acoustic Mixing

A 60 gram perfluoroalkoxy polymer resin sample was mixed with 1.5 grams (2.5 wt %) of silica aerogel and 0.3 g (0.5 weight percent) of SpectrAl™ 100 in the Resodyn™ Acoustic Mixer for 2 minutes at 100% intensity, 95 G force, resonating at 61.2 Hz for two minutes.

Fuji Blending

A 60 gram perfluoroalkoxy polymer resin sample was mixed with 1.5 grams (2.5 weight percent) of silica aerogel and 0.3 grams (0.5 weight percent) of SpectrAl™ 100 in a commercially available Fuji blender (blade mixing) for 1 minute at 13500 rpm.

Turbula

A 60 gram perfluoroalkoxy polymer resin sample was mixed with 1.5 grams (2.5 weight percent) of silica aerogel and 0.3 grams (0.5 weight percent) of SpectrAl™ 100 in a Tubula® mixer for 20 minutes.

Paint Shaker 25 grams of perfluoroalkoxy polymer resin e, 0.625 grams of silica aerogel and 0.125 grams of SpectrAl™ 100 were placed in four 60 ml-bottles. The bottles were placed on each arm of the Paint Shaker and shaken for 30 minutes. Then the mixture was combined in one big plastic bottle and rolled on the mill for 20 minutes to obtain a uniform mixture.

Powder Coating

Blank Olympia rolls were powder coated using an Encore Manual Powder Spray System from Nordson. A roll was first cleaned with isopropyl alcohol by wiping. The roll was then suspended in air with two aluminum ends sitting on two fuser roll holders. The grounding of the roll was achieved through the attachment of the aluminum end to the grounding wire. The powder mixture was loaded in the cup attached to the spray gun. For all experiments disclosed herein, the default charge mode (100 kV, 15 uA) was selected. The default flow air was 0.65 $m^3$/hr and atomizing air 0.7 $m^3$/hr. The tip of the gun to the roll was manually maintained at about 4 inches. The powder mixture was sprayed onto the roll by moving the gun slowly along the roll direction.

The coated rolls were baked in a Grieve oven for 31 minutes at 340° C. to allow the PFA to melt and cure.

Roll coatings prepared using the Resodyn™ acoustic mixer were well coalesced, homogenous, and yielded a surface gloss of about 39.7 ggu. In comparison, the roll coating obtained by blending with a Fuji blender yielded a roll that was very poorly coalesced, indicated by a whitish appearance and a very low gloss value (6.7 ggu). Poorly coalesced coatings results in toner trapping and are not feasible for fusing. This blending process with a rotating blade is thought to break down aerogel particles to create fine particles that interfere with the curing of the topcoat.

Gentler mixing methods using either the Tubula or Paint Shaker eliminate the formation of fine particles. However, in order to efficiently mix the particles, these methods required long processing times (20-30 minutes). Roll coatings were coalesced and homogenous; however, large agglomerates (~100 microns) were evident on the surface, and shown by SEM to be composed of aggregated silica and alumina. In comparison, the short acoustic mixing time does not result in agglomerates formation.

To summarize, the optical microscope images of powder mixtures by different mixing techniques indicates a higher degree of association of particles mixed by Resodyn™ acoustic mixer. The silica aerogel particles get broken down to fine particles in the high shear mixer (Fuji blender), an undesirable process leading to powder variability and poor coelescence. Large agglomerates occur when using a Paint Shaker or Turbula mixer.

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled the in the art which are also encompassed by the following claims.

What is claimed is:

1. A process comprising:

obtaining a composition of particles consisting of: fluorine containing particles, positive tribocharging particles and aerogel particles;

mixing the composition at a resonant frequency of an acoustic mixing system containing the composition;

powder coating the composition onto a substrate; and curing the composition to form a release layer on the substrate.

2. The process according to claim 1, wherein the fluorine containing particles comprise a polymer selected from the group consisting polytetrafluoroethylene; perfluoroalkoxy polymer resin; copolymers of tetrafluoroethylene and hexafluoropropylene; copolymers of hexafluoropropylene and vinylidene fluoride; terpolymers of tetrafluoroethylene, vinylidene fluoride, and hexafluoropropylene; and tetrapolymers of tetrafluoroethylene, vinylidene fluoride, and hexafluoropropylene.

3. The process according to claim 1, wherein the fluorine containing particles comprises a particle size of from about 5 microns to about 50 microns.

4. The process according to claim 1, wherein the positive tribocharging particles comprise a material selected from the group consisting of alumina, silica, zirconia and germania.

5. The process according to claim 1, wherein an amount of positive tribocharging particles is from about 0.1 weight percent to about 5 weight percent of the total solids in the composition.

6. The process according to claim 1, wherein the resonant frequency is from about 15 Hertz to about 2000 Hertz.

7. The process according to claim 1, wherein the curing comprises heating the composition to a temperature of from about 255° C. to about 400° C.

8. The process according to claim 1, wherein the aerogel particles comprise from about 0.1 weight percent to about 10 weight percent of the composition.

9. A process comprising:

obtaining a composition of particles comprising fluorine containing particles, aerogel particles and positive tribocharging particles, wherein the positive tribocharging particles are present in an amount of from about 0.1 weight percent to about 5 weight percent of the composition;

mixing the composition at a resonant frequency of an acoustic mixing system containing the composition;

electrostatically spray coating the composition onto a substrate; and curing the composition to form a release layer on the substrate.

10. The process according to claim 9, wherein the aerogel particles comprise from about 0.1 weight percent to about 10 weight percent of the composition, and the fluorine containing particles comprise from about 70 weight percent to about 99 weight percent of the composition.

11. The process according to claim 9, wherein the fluorine containing particles comprise a polymer selected from the group consisting polytetrafluoroethylene; perfluoroalkoxy polymer resin; copolymers of tetrafluoroethylene and hexafluoropropylene; copolymers of hexafluoropropylene and vinylidene fluoride; terpolymers of tetrafluoroethylene, vinylidene fluoride, and hexafluoropropylene; and tetrapolymers of tetrafluoroethylene, vinylidene fluoride, hexafluoropropylene and a cure site monomer.

12. The process according to claim 9, wherein the curing comprises heating the composition to a temperature of from about 255° C. to about 400° C.

13. The process according to claim 9, wherein the positive tribocharging particles comprise a material selected from the group consisting of alumina, silica, zirconia and germania.

14. The process according to claim 9, wherein the positive tribocharging particles comprise a particles size of from about 5 nm to about 1 μm.

15. The process according to claim 9, wherein the positive tribocharging particles comprise fumed alumina particles having a surface area of from about 30 $m^2/g$ to about 400 $m^2/g$.

16. The process according to claim 9, wherein the resonant frequency is from about 15 Hertz to about 2000 Hertz.

17. The process according to claim 9, wherein the mixing comprises accelerating the composition at a G force of from about 1 to about 100.

18. A process comprising:

obtaining a composition of particles comprising perfluoroalkoxy polymer resin particles, aerogel particles and positive charged fumed alumina articles, wherein the positive charged fumed alumina particles are present in an amount of from about 0.5 weight percent to about 1.5 weight percent of the composition;

mixing the composition at a resonant frequency of an acoustic mixing system containing the composition electrostatically spray coating the composition onto a substrate; and curing the composition to form a release layer on the substrate.

* * * * *